United States Patent [19]

Waldo

[11] 4,061,383

[45] Dec. 6, 1977

[54] AUTOMATICALLY LOCKING CROSSBOLT DEADLOCK

[75] Inventor: Russell W. Waldo, St. Paul, Minn.

[73] Assignee: Ideal Security Hardware Corporation, St. Paul, Minn.

[21] Appl. No.: 734,734

[22] Filed: Oct. 21, 1976

[51] Int. Cl.[2] ..... E05C 1/16

[52] U.S. Cl. ..... 292/335

[58] Field of Search ..... 292/332–336, 292/150, 153, 210

[56] References Cited

U.S. PATENT DOCUMENTS

| | | | |
|---|---|---|---|
| 1,162,406 | 11/1915 | Segal | 292/335 |
| 1,330,693 | 2/1920 | Fisher | 292/335 |
| 2,070,149 | 2/1937 | Turner | 292/252 |
| 2,158,088 | 5/1939 | Segal | 292/335 |
| 2,344,451 | 3/1944 | Pankhurst | 292/335 |
| 2,597,056 | 5/1952 | Beder | 292/335 |
| 2,639,177 | 5/1953 | Smith | 292/169 |
| 2,660,752 | 12/1953 | Carcereny | 16/147 |
| 2,711,920 | 6/1955 | Farnsworth | 292/169 |
| 2,942,449 | 6/1960 | White | 70/1.5 |
| 2,995,394 | 8/1961 | Browning | 292/159 |

*Primary Examiner*—Richard E. Moore

*Attorney, Agent, or Firm*—Merchant, Gould, Smith, Edell, Welter & Schmidt

[57] ABSTRACT

An automatically locking crossbolt deadlock having a crossbolt yieldingly urged toward locking engagement with a cooperating strike when the deadlock and strike are mounted on a door and door frame respectively. An actuator lever releasably holds the crossbolt in a retracted or unlocking position while the door is open, and includes a portion which engages the strike, upon closing of the door, to cause the actuator lever to automatically release the crossbolt for movement into locking engagement with the strike. A cam and drive lever operate to move the crossbolt out of engagement with the strike to permit opening of the door, and a latch is engageable with the crossbolt, when the crossbolt is moved to its retracted position, to hold the same retracted until the door is opened and the actuating lever engages the crossbolt.

9 Claims, 12 Drawing Figures

AUTOMATICALLY LOCKING CROSSBOLT DEADLOCK

BACKGROUND OF THE INVENTION

This invention relates to crossbolt locks and more particularly to improvements in such locks as are disclosed in U.S. Pat. No. 3,746,380 and 3,760,619, assigned to the assignee corporation of this invention. Crossbolt locks are well known and are usually of the deadbolt variety, the bolts thereof being manually moved between locked and unlocked positions.

SUMMARY OF THE INVENTION

A preferred form of the lock of this invention involves, a housing adapted to be mounted on a door hinged in a door frame, the housing defining notch means opening generally toward an adjacent portion of the door frame, and a strike adapted to be mounted on the door frame and having apertured lug means for reception in the notch means when the door is closed. A crossbolt is mounted in the housing for linear sliding movements relative to said housing and toward and away from locking engagement with said strike. An actuator lever is disposed in said housing for releasably holding said crossbolt in a position away from engagement thereof with said strike, the actuator lever having an inner end within the housing, an angularly displaced outer end projecting outwardly through an opening in said housing and toward the door frame when the housing is mounted on the door, and a crossbolt engaging portion intermediate its ends within said housing. Means are provided pivotally mounting said inner end of the actuator lever to said housing for swinging movements toward and away from engagement of said crossbolt engaging portion with said crossbolt, and spring means urges said actuator lever in a direction of said swinging movement toward said crossbolt. The outer end of the actuator lever is disposed to abuttingly engage a portion of said strike spaced from said lug means responsive to closing of the door to move said actuator lever in a direction to disengage the crossbolt engaging portion thereof from said crossbolt against bias of said spring means. Means for moving said crossbolt into and out of locking engagement with said strike includes a spring yieldingly urging the crossbolt toward engagement with said strike, and a cam rotatably mounted in said housing and operative to move said crossbolt in a strike releasing position against bias of the spring. The invention is further characterized by a recess defined by the crossbolt, a latch, latch mounting means mounting said latch in said housing for moving said latch in a direction transversely of the direction of movement of the crossbolt toward and away from reception of the latch in said recess, said latch being yieldingly biased toward said crossbolt, and a latch releasing element on said actuator lever engages said latch mounting means for moving said latch out of the recess against the yielding bias applied thereto and responsive to movement of the actuator lever toward holding engagement with said crossbolt.

DETAILED DESCRIPTION OF THE PREFERRED EMBODIMENT

Figure 2:
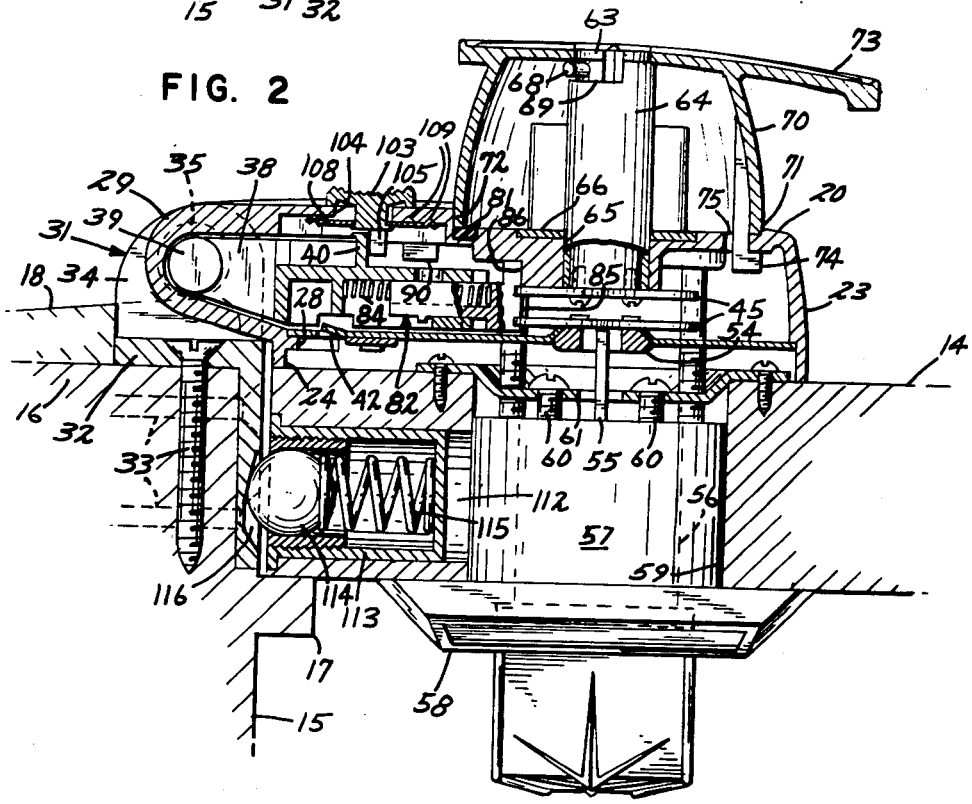
FIG. 2 is an enlarged fragmentary section taken generally on the line 2—2 of FIG. 1.

A conventional door and door frame are shown fragmentarily, and indicated generally at 14 and 15 respectively, the door frame 15 including an upright frame member 16 toward which the door moves in a closing direction. In FIG. 2, the door frame member 16 is shown as including a stop strip 17, the frame member 16 being provided with a decorative molding 18.

Figure 1:
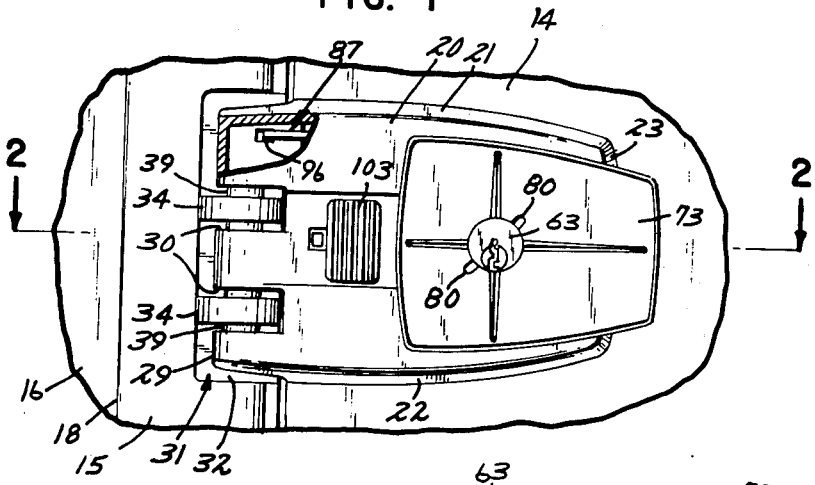
FIG. 1 is a fragmentary view in side elevation of a door and a cooperating door frame, with the crossbolt lock of this invention being mounted thereon, some parts being broken away and some being shown in section.

The door lock of this invention includes a housing 19 having an outer or front wall 20, top and bottom walls 21 and 22 respectively, and opposite end walls 23 and 24. An inner or rear wall of the housing is formed by a removable plate 25 that engages the ends of a pair of mounting bosses 26 integrally formed with the housing 19, the plate 25 being secured to the bosses 26 by machine screws or the like 27. The plate 21 is further engaged by a pair of mounting lugs 28 formed on the interior surface of the end wall 24. The end wall 24 is formed to provide a longitudinally outwardly projecting nose portion 29 that is cut away to provide a pair of vertically spaced slot-like motches or openings 30 to the interior of the housing 19. As shown particularly in FIGS. 1 and 2, when the door 14 is closed against the stop strip 17, the nose portion 29 of the housing 19 projects laterally outwardly from the adjacent edge of the door 14 and over a portion of the door frame member 16. A strike 31 includes a base portion 32 that is rigidly secured to the door frame member 16 by screws or the like 33. The strike 31 further includes a pair of vertically spaced lugs 34 that are positioned to be received within respective ones of the notches 30 when the door is closed. The lugs 34 are provided with axially aligned openings 35 that are positioned to be in communication with the interior of the nose portion 29 when the door 14 is closed.

A crossbolt, indicated generally at 36, is mounted in the housing 19 for reciprocatory movement in generally vertical direction, and comprises a main body portion 37, a pair of vertically spaced arms 38 that project laterally into the interior of the housing nose portion 29, and a pair of axially aligned bolt portions 39 that extend in a generally vertical direction from each of the arms 38 so as to move transversely into and out of respective ones of the notches 30 and, when the door 14 is closed, into one of the openings 35 of a respective one of the strike lugs 34. The crossbolt body 37 is formed to provide a rail 40 that extends longitudinally of the direction of movement of the crossbolt 36 and which is slidably contained in a guide channel 41 formed in the interior of the front housing wall 20. The inner wall or plate 25 is formed to provide a generally inwardly projecting flange 42, the edge of which slidably engages a portion of the crossbolt body portion 37 to assist in guiding the crossbolt 36 in its sliding movements within the housing 19.

Figure 6:
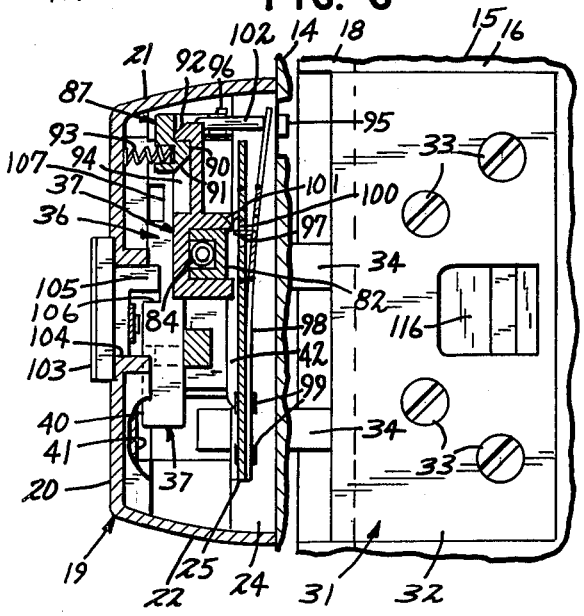
FIG. 6 is a view corresponding generally to FIG. 5 but showing a different position of some of the parts.
Figure 8:
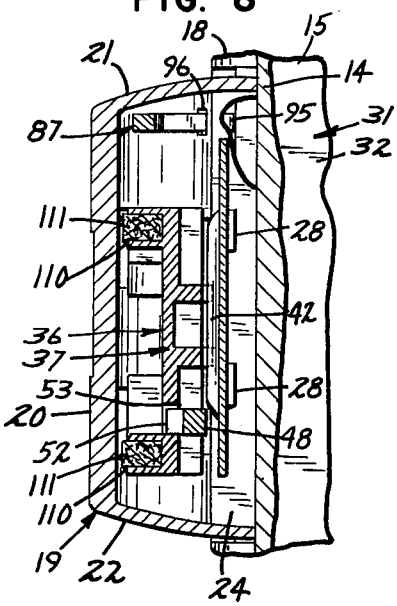
FIG. 8 is a fragmentary section taken generally on the line 8—8 of FIG. 3.
Figure 7:
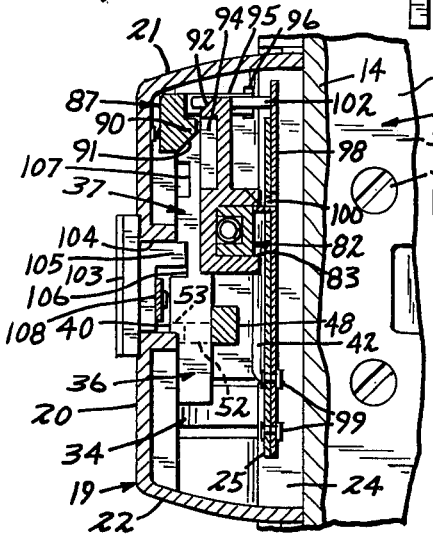
FIG. 7 is a view corresponding to FIG. 5 but showing a still different position of some of the parts.
Figure 12:
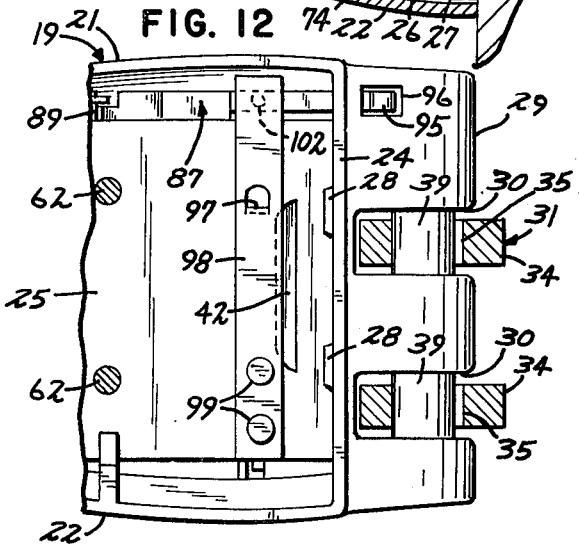
FIG. 12 is a fragmentary view corresponding to a portion of FIG. 3 but showing portions omitted from FIG. 3.

Means for moving the crossbolt 36 between a strike engaging position shown in FIGS. 1, 3, 8 and 12, and an unlocked position wherein the bolt portions 39 are retracted or disengaged from their respective strike lugs 34, as shown in FIGS. 6 and 7, includes a drive lever 43 that is pivotally mounted intermediate its ends on a shaft 44, a pair of like rotary cams 45, and a coil compression spring 46. The drive lever 43 comprises relatively short and relatively long lever arms 47 and 48 respectively, the former of which has an outer end portion 49 that engages the cams 45. Adjacent its end 49, the short lever arm 47 is formed to provide a socket 50 for reception of one end of the spring 46, the opposite end being supported in a socket 51 in the housing bottom wall 22, see particularly FIG. 3. The outer end of the long lever arm 48 is formed to provide a cylindrical boss 52 that is received in a cavity 53 in the crossbolt body 37. The spring 46 yieldingly urges the lever end 49 toward engagement with the cams 45, and urges the crossbolt 36 toward its locking position wherein the bolt portions 39 are received in the openings 35 of the strike lugs 34.

The cams 45 are mounted for rotation on a common axis in much the same manner as corresponding cams disclosed in the above-mentioned U.S. Pat. No. 3,760,619. One of the cams 45 is mounted on a hub 54 that is journaled in the inner wall or plate 25, the hub 54 being slotted to receive an end portion of a lock spindle 55 that is operatively connected to a cylinder lock, not shown, but contained within a body 56 shown by dotted lines in FIG. 2. The body 56 is disposed within the hollow base portion 57 of a handle equipped escutcheon 58. The base portion 57 is contained in a bore 59 extending transversely through the door 14, the body 56 being secured within the base portion 57 by a pair of mounting screws 60 that may be assumed to be screw-threaded in the body 56, and which extend through a retainer plate 61 secured to the door 14 opposite the escutcheon 58. The escutcheon 58 is rigidly secured to its respective side of the door 14 by a plurality of anchoring screws 62 circumferentially spaced about the axis of the spindle 55, extending through suitable apertures in the housing wall 20 and retainer plate 61 and screw threaded into the base portion 57 of the escutcheon 58.

Figure 11:
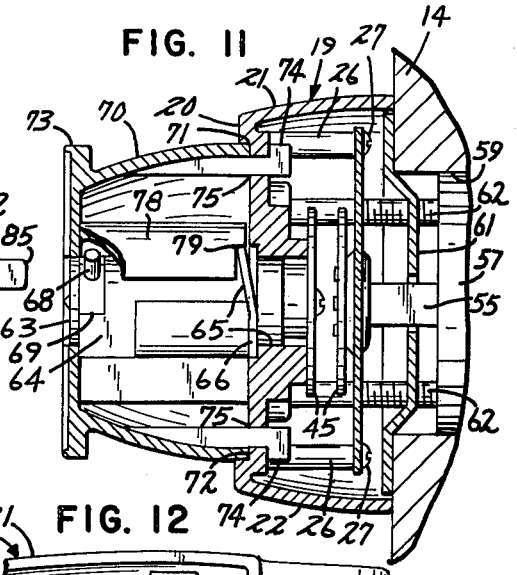
FIG. 11 is a fragmentary view partly in elevation and partly in section, taken on the irregular line 11—11 of FIG. 9, on a slightly reduced scale.

In the embodiment of the lock illustrated, the other one of the cams 45 is rigidly secured to the inner end of a key operated lock cylinder 63 that is rotatably mounted in casing 64 in axial alignment with the lock spindle 55, the casing 64 extending through an opening 65 in the front wall 20 of the housing 19. A plate like resilient abutment member 66 is interposed between the casing 64 and the housing front wall 20, the casing 64 and abutment member being rigidly secured to the front wall by machines screws or the like 67, see FIG. 9. Rotary movement of the lock cylinder 63 within the casing 64 is limited by engagement of a pin 68 extending radially outwardly of the lock cylinder 63, with the ends of a notch 69 in the casing 64, see FIGS. 2 and 11.

Figure 9:
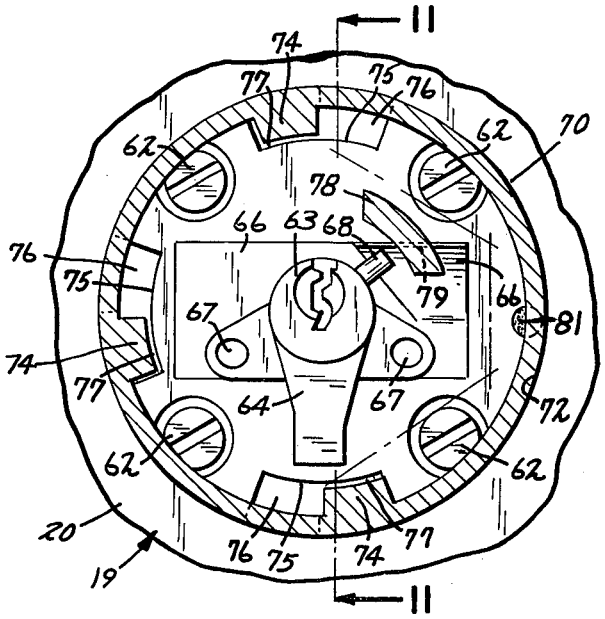
FIG. 9 is an enlarged fragmentary section taken on the line 9—9 of FIG. 4.
Figure 10:
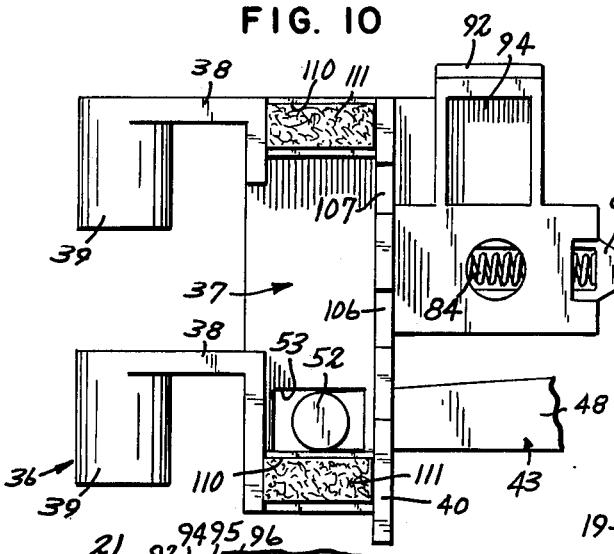
FIG. 10 is an enlarged view in side elevation of the crossbolt of this invention, as seen from the side opposite that of FIG. 3.

The heads of the anchoring scres 62, as well as the casing 64, are covered by a cup-shaped shield 70 having a marginal edge 71 disposed within a recess 72 in the housing front wall 20. At its outer end, the shield 70 is formed to provide an enlarged generally plate-like handle portion 73 by means of which the door may be pulled open from the inside. Further, the outer end of the shield 70 defines an opening for reception of the outer end of the lock cylinder 63, see particularly FIGS. 1 and 2. The shield 70 is releasably held in engagement with the front housing wall 20 by circumferentially spaced bayonet hooks or lugs 74 that extend generally axially inwardly from the marginal edge portion 71 of the shield 70 and through generally L-shaped openings 75 having relatively wide and narrow portions 76 and 77 respectively, in the housing front wall 20. When the shield 70 is applied to the housing 19, the hooks 74 are inserted in the wide portions 86 of the openings 75, after which the shield is rotated to move the hooks 74 into the narrow portions 77. The shield 70 further includes an interior leg 78 that is formed to provide an axially projecting shoulder 79 that engages an edge of the abutment member 66 to prevent rotation of the shield 70 in a direction to remove the same from the housing 19. The opening in the outer end of the shield 70 is formed to provide one or more notches 80 through which a pin may be inserted to depress the resilient abutment member 66 to enable the shield 70 to be removed, if desired. With reference to FIGS. 2 and 9, it will be seen that the recessed portion of the front wall 20 is provided with a resilient pad 81 that engages an adjacent portion of the marginal edge 71 to serve as a cushion for the shield 70 and take up whatever play may exist between the shield 70 and the housing 19 when the shield 70 is locked thereon.

For the purpose of releasably locking the crossbolt 36 in its strike engaging position, a retainer member 82 is mounted for sliding movements transversely of the direction of movement of the crossbolt 36, within a recess 83 in the crossbolt portion 37. A coil compression spring 84 within the recess 83 yieldingly urges the retainer member 82 in a direction to move the outer end 85 of the retainer member 82 into a notch 86 in the housing 19 and into engagement with both of the cams 45. The cams 45 are so shaped that, upon initial rotation of either thereof from a neutral position, the retainer member portion 85 is first moved out of the notch 86, after which movement is imparted by the cam 45 to the drive lever 43 in a direction to move the crossbolt 36 toward its retracted or released position out of engagement with the strike lugs 34.

Figure 3:
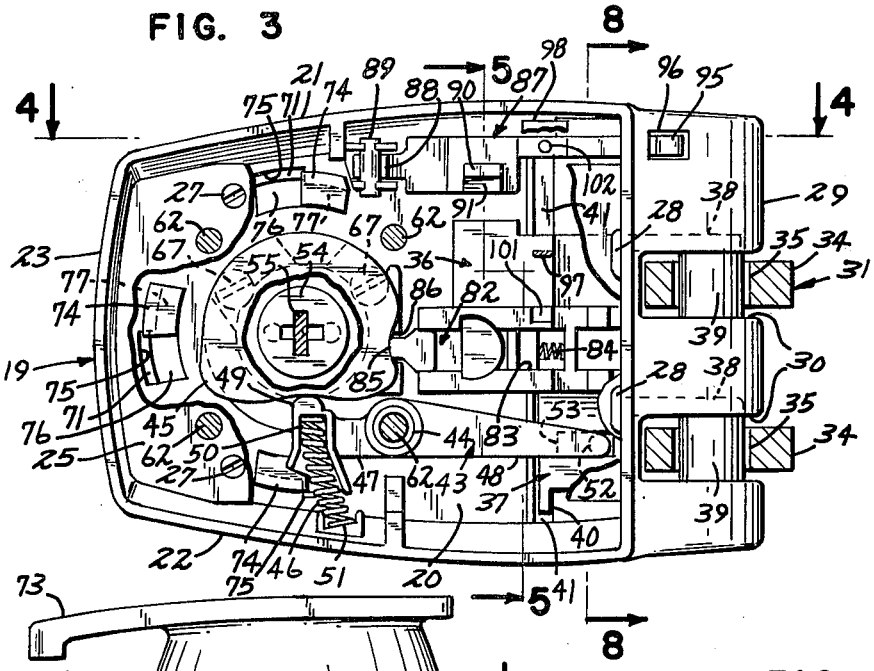
FIG. 3 is an enlarged view in elevation of the side of the lock opposite that shown in FIG. 1, some parts being broken away and some parts being shown in section.

An elongated actuator lever 87 is used to releasably hold the crossbolt 36 in its retracted position out of engagement with the strike lugs 34, and has a hooked shaped inner end 88 that partially encompasses a fulcrum pin 89 suitably mounted in the housing 19, as shown in FIG. 3. Intermediate its ends, the actuator lever 87 is formed to provide a hook-like protuberance 90 having a cam surface 91 that is adapted to have camming engagement with a cooperating cam surface 92 on the crossbolt 36, when the crossbolt 36 is moved toward its retracted position of FIG. 6. A coil compression spring 93 yieldingly urges the actuator lever 87 in the direction of its pivotal movement to move the hook portion 90 into a recess 94 in the crossbolt body portion 37, whereby to securely but releasably hold the crossbolt 36 in its retracted position.

The actuator lever 87 includes an angularly displaced outer end portion 95 that projects outwardly from the housing 19 through an opening 96 in the nose portion 29 adjacent the top housing wall 21. The end portion 95 is disposed to engage the base portion 32 of the strike 31 upon closing of the door 14 to move the actuator lever 87 against bias of the spring 93 in a direction to move the protuberance 90 out of the recess 94, whereby to permit the spring 46 to swing the driver lever 43 in a direction to move the crossbolt 36 into interlocking engagement of the bolt portions 39 thereof with the strike lugs 34. As the crossbolt 36 moves to its locking position, the outer end 85 of the retainer member 82 moves into the notch 86 to positively lock the crossbolt 36 against movement away from interengaging relationship with the strike lugs 34.

Figure 4:
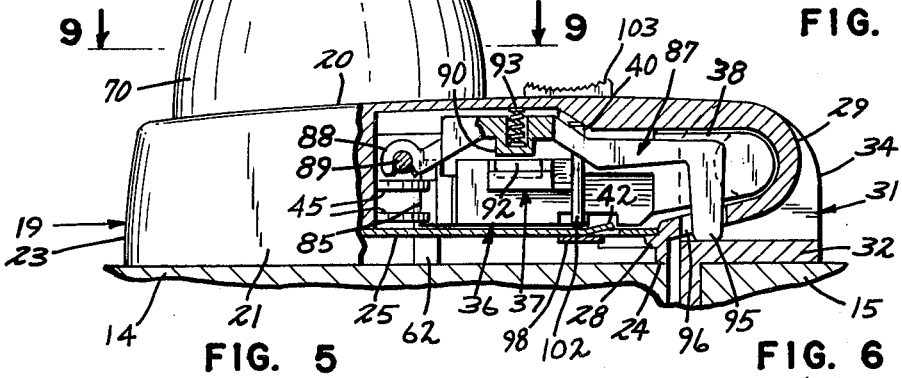
FIG. 4 is a view partly in plan and partly in section, taken generally on the line 4—4 of FIG. 3.
Figure 5:
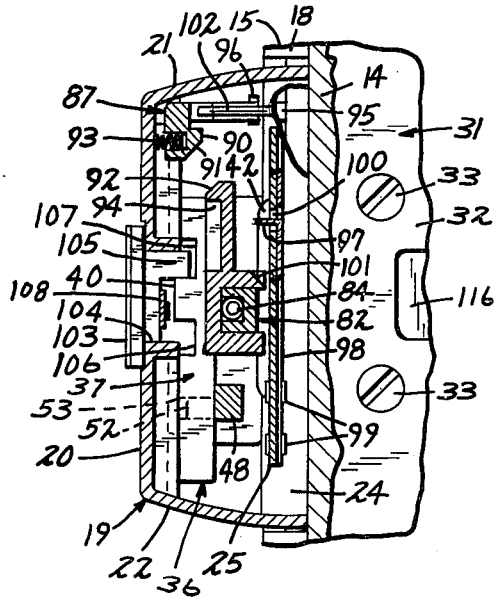
FIG. 5 is a fragmentary section taken on the irregular line 5—5 of FIG. 3.

The portions of the lock, above described, permit the crossbolt 36 to be moved out of engagement with the strike lugs 34 by means of a suitable key, not shown, inserted into the lock cylinder 63 or the lock within the body 56 and rotated to impart rotation to an associated one of the cams 45. The cams 45 are so shaped that rotation in either direction will impart movement to the retainer member 82 to retract its outer end 85 from the notch 86, and to swing the drive lever 43 in a direction to retract the bolt portions 39 from the strike lug openings 35. While the door 14 is closed, the actuator lever 87 remains in its crossbolt release position out of engagement with the crossbolt 36, as shown in FIGS. 4 and 7. For the purpose of holding the crossbolt 36 in its unlocked or retracted position until the door is opened and the protuberance 90 is received in the recess 94, a latch 97 is provided for reception in the recess 83 of the crossbolt body 37. The latch 97 is integrally formed with an elongated leaf spring 98 that is anchored at one end portion to the inner wall 25, by suitable means such as rivets 99. The latch 97 is disposed intermediate the ends of the spring 98, and projects laterally therefrom through an opening 100 in the inner wall 25 and toward the recess 83, the leaf spring 98 exerting yielding bias to the latch 97 toward said recess 83. The crossbolt body portion 37 is formed to provide a cam surface 101 that engages the end of the latch 97, during retracting movement of the crossbolt 36, to move the latch 97 out of the path of the adjacent portion of the crossbolt body 37. When the cam surface 101 passes the latch 97, the latch 97 moves into the recess 83 and engages a side wall of the recess 83 to hold the crossbolt in its retracted position while the door is being opened and the protuberance 90 is permitted to move into the recess 94. The free end of the leaf spring 98, opposite the end portion engaged by the rivets 99, is disposed laterally outwardly from one side edge of the iner wall 25, and overlies the outer end of a latch releasing element in the nature of a pin 102 projecting transversely from the actuator lever 87. As the door opens, the spring 93 swings the actuator lever 87 toward the crossbolt 36, so that the protuberance 90 enters the recess 94 just as the latch 97 moves out of the recess 83, to hold the crossbolt in its retracted or unlocking position. Thus it will be seen that, when a key is turned to retract the crossbolt 36, the crossbolt is automatically held retracted until the door is opened, thus making it unnecessary to use both hands to hold the crossbolt retracted and to open the door. When the door is closed, the pin 102 permits movement of the latch 97 into the path of movement of the cam surface 101 just after the crossbolt has been disengaged by the protuberance 90, so that the crossbolt 36 is permitted to move into locking engagement of the bolt portion 39 with the strike lugs 34.

As can be readily ascertained from the above, the latch 97 is intended for temporary operation to permit opening of the door with one hand as well as to permit removel of the key after the crossbolt has been retracted and before opening the door, particularly from the inside and with use of the handle portion 73. For positively holding the crossbolt 36 in either its strike engaging position or its retracted position, a safety lock 103 is slidably mounted in an opening 104 in the housing front wall 20. The safety lock 103 is formed to provide a lug portion 105 that is receivable in a selected one of a pair of notches 106 and 107 in the crossbolt body 37. The safety lock 103 is provided with a leaf spring 108 formed to provide a detent that is receivable in a pair of notches 109 on the interior surface of the housing front wall 20 to releasably hold the safety lock 103 in a locking or unlocking position with respect to the crossbolt 36. With the lug portion 105 received within the crossbolt notch 106, the door 14 can be opened or closed at will, and the crossbolt 36 cannot be moved to its locking position in operative engagement with the strike 31. When the door is locked, with the slide lock lug portion 105 received within the notch 107, the crossbolt cannot be retracted from its locking position with use of a key from either side of the door.

For ease of operation, the crossbolt body portion 37 is provided with a pair of pockets 110 which contain absorbent pads 111 that are soaked with lubricant, and which have wiping engagement with inner surface portions of the housing front wall 20.

When the door 14 is devoid of latch means separate from the above described lock mechanism, the door 14 may be provided with a bore 112 for reception of a detent comprising a casing 113, a ball detent element 114, and a coil compression spring 115 urging the detent element 114 in a direction to be received in a recess 116 in the base portion 32 of the strike 31, see FIG. 2.

It will be appreciated that, if desired, the lock cylinder 63 with its casing 64 and shield 70 may be removed, and replaced by a manually operated knob of the type shown in the above-mentioned U.S. Pat. No. 3,746,380, or any handle-equipped knob, not shown. In this event, the front wall 20 of the housing 19 would be modified in the manner of the housing shown in said U.S. Pat. No. 3,746,380 to accomodate such a knob. It will be understood that such modifications and further modifications may be made without departure from the spirit and scope of the invention, as defined in the claims.

I claim:

1. A crossbolt deadlock comprising:

a housing adapted to be mounted on a door hinged in a door frame, said housing defining notch means opening generally toward an adjacent portion of the door frame;

a strike adapted to be mounted on the door frame and having apertured lug means for reception in the notch means when the door is closed;

a crossbolt mounted in the housing for linear sliding movements relative to said housing and toward and away from locking engagement with said strike;

an actuator lever in said housing for releasably holding said crossbolt in a position away from engagement thereof with said strike, said actuator lever having an inner end within said housing, an angularly displaced outer end projection outwardly through an opening in said housing and toward the door frame when said housing is mounted on the door, and a crossbolt engaging portion intermediate its ends within said housing;

means pivotally mounting said inner end of the actuator to said housing for swinging movements toward and away from engagement of said crossbolt engaging portion with said crossbolt;

spring means urging said actuator lever in a direction of said swinging movement toward said crossbolt;

said outer end of the actuator lever being disposed to abuttingly engage a portion of said strike spaced from said lug means responsive to closing of the door to move said actuator lever in a direction to disengage the crossbolt engaging portion thereof from said crossbolt against bias of said spring means;

and means for moving said crossbolt into and out of locking engagement with said strike and including a spring yieldingly urging said crossbolt toward engagement with said strike, and a cam rotatably mounted in said housing and operative to move said crossbolt in a strike releasing direction against bias of said spring;

characterized by a recess defined by said crossbolt, a latch, latch mounting means mounting said latch in said housing for moving said latch in a direction transversely of the direction of movement of said crossbolt toward and away from reception of said latch in said recess, said latch being yieldingly biased toward said crossbolt, and a latch releasing element on said actuator lever engaging said latch mounting means for moving said latch out of said recess against the yielding bias applied thereto responsive to movement of said actuator lever toward holding engagement with said crossbolt.

2. The crossbolt defined in claim 1 further characterized by a cam surface and a cam follower portion one on said crossbolt and the other on said latch for moving said latch out of the crossbolt in the direction of disengagement thereof from said strike.

3. The crossbolt deadlock defined in claim 1 in which said mounting means comprises an elongated leaf spring secured at one end of said housing and providing said yielding bias to said latch.

4. The crossbolt deadlock defined in claim 3 in which said latch comprises an angularly displaced portion of said leaf spring intermediate the ends of said spring.

5. The crossbolt deadlock defined in claim 3 in which said crossbolt defines a cam surface adjacent said recess, said latch comprising an angularly displaced portion of said leaf spring, said latching having an outer end providing a cam follower engaging said cam surface upon movement of said crossbolt in the direction of disengagement thereof from said strike.

6. The crossbolt deadlock defined in claim 3 in which said lead spring has a free end portion opposite said one end and engaged by said latch releasing element.

7. The crossbolt deadlock defined in claim 1 in which said means for moving the crossbolt includes a drive lever pivotally mounted in said housing and having one end operatively coupled to the crossbolt, said spring engaging said drive lever to urge said crossbolt toward said engagement with the strike, said cam engaging a portion of said drive lever in opposition to said spring.

8. The crossbolt deadlock defined in claim 7 in which said drive lever is pivotally mounted intermediate its ends to said housing and defines relatively long and relatively short lever arms projecting from the axis of the pivotal mounting of said drive lever, said cam engaging said relatively short lever arm.

9. The crossbolt deadlock defined in claim 8 in which said crossbolt defines a cavity opening transversely of the direction of crossbolt movement, said relatively long lever arm including a crossbolt engaging boss received in said cavity.

* * * * *

UNITED STATES PATENT AND TRADEMARK OFFICE

CERTIFICATE OF CORRECTION

PATENT NO. : 4,061,383

DATED : December 6, 1977

INVENTOR(S) : Russell W. Waldo

It is certified that error appears in the above-identified patent and that said Letters Patent are hereby corrected as shown below:

Abstract, line 10, "A cam and drive lever" should be --A cam and a drive lever--.

Column 2, line 50, "motches" should be --notches--.

Column 3, line 63, "in casing" should be --in a casing--.

Column 4, line 6, "scres" should be --screws--.

Column 6, line 10, "removel" should be --removal--.

Column 6, line 51, "accomodate" should be --accommodate--.

Column 7, line 3, "projection" should be --projecting--.

UNITED STATES PATENT AND TRADEMARK OFFICE

CERTIFICATE OF CORRECTION

PATENT NO. : 4,061,383

DATED : December 6, 1977

INVENTOR(S) : Russell W. Waldo

It is certified that error appears in the above-identified patent and that said Letters Patent are hereby corrected as shown below:

Column 8, line 8, "of" should be --to--.

Column 8, line 16, "latching" should be --latch--.

Column 8, line 21, "lead" should be --leaf--.

Signed and Sealed this

*Fourth* Day of *April 1978*

[SEAL]

*Attest:*

RUTH C. MASON
*Attesting Officer*

LUTRELLE F. PARKER
*Acting Commissioner of Patents and Trademarks*